United States Patent [19]

Moss

[11] Patent Number: 4,532,862

[45] Date of Patent: Aug. 6, 1985

[54] PRINT HAMMER BANK

[75] Inventor: James R. Moss, Lum, Mich.

[73] Assignee: Centronics Data Computer Corp., Hudson, N.H.

[21] Appl. No.: 509,925

[22] Filed: Jul. 1, 1983

[51] Int. Cl.[3] ..... B41J 9/10

[52] U.S. Cl. ..... 101/93.32; 101/93.09; 101/93.48

[58] Field of Search ..... 101/93.04, 93.09, 93.29, 101/93.32, 93.33, 93.34, 93.48; 29/602; 335/274, 275

[56] References Cited

U.S. PATENT DOCUMENTS

| | | | |
|---|---|---|---|
| 3,142,784 | 7/1964 | Bloomfield | 335/275 |
| 3,349,696 | 10/1967 | Potter | 101/93.33 |
| 3,672,482 | 6/1972 | Brumbaugh et al. | 101/93.04 |
| 3,726,213 | 4/1973 | Herbert | 101/93.33 |
| 3,745,917 | 7/1973 | Cavella | 101/93.48 |
| 3,919,933 | 1/1975 | Potter | 101/93.32 |
| 4,101,017 | 7/1978 | Englund et al. | 101/93.34 |
| 4,200,043 | 4/1980 | Nozaki et al. | 101/93.29 |
| 4,379,428 | 4/1983 | Schmulian | 101/93.48 |
| 4,397,234 | 8/1983 | Lee et al. | 101/93.48 |
| 4,402,620 | 9/1983 | Kekas et al. | 101/93.04 |
| 4,421,025 | 12/1983 | Thorne et al. | 101/93.48 |

FOREIGN PATENT DOCUMENTS

| | | | |
|---|---|---|---|
| 2061155 | 12/1979 | Fed. Rep. of Germany | 101/93.48 |
| 2151296 | 3/1981 | Fed. Rep. of Germany | 101/93.48 |

OTHER PUBLICATIONS

R. H. Sweat, Jr. et al.; "Molded Plastic Missle Lever Arm Assembly"; *IBM Technical Disclosure Bulletin;* vol. 25, No. 11B, pp. 5987–5988, Apr. 1983.

*Primary Examiner*—Edgar S. Burr
*Assistant Examiner*—David A. Wiecking
*Attorney, Agent, or Firm*—Pahl, Lorusso & Loud

[57] ABSTRACT

Disclosed is a free-flight hammer, impact-printing apparatus including a shifting hammer bank having a plurality of interchangeable hammer modules. Each hammer module includes a plurality of individual linear motion, slidable hammers which are mounted in a side by side relationship in a hammer housing. Each hammer housing also includes a hammer-return spring mounted adjacent a hammer for causing the hammer to return to a set position. The hammers are caused to strike a moving record medium by a plurality of interchangeable actuator modules which each include an actuator assembly. Each actuator assembly comprises a stator housed in a stator housing, a solenoid assembly and an armature. The solenoid assembly is mounted between the stator and the armature. The armature actuates pushrods, which are slidably mounted in the stator housing, in order to cause a hammer to strike. A second actuator assembly can be mounted behind the first actuator assembly relative to the hammer modules so that the first actuator assembly can actuate two hammers through the interaction between the two adjacent actuator modules.

4 Claims, 14 Drawing Figures

PRINT HAMMER BANK

BACKGROUND OF THE INVENTION

1. Field of the Invention

This invention relates to improvements in on-the-fly, free-flight hammer, impact-printing machanisms. The improvements are particularly useful in high-speed line printers employing a number of identical printing units of the impact type. More particularly, the invention relates to a lightweight, easily-manufactured hammer module-actuator module combination providing high print quality at low cost with minimal service requirements. The invention further pertains to a simple, low-cost, hammer-bank shifting mechanism to be used in conjunction with a set of lightweight hammer modules.

2. Description of the Prior Art

On-the-fly, high-speed impact printers designed for use as output devices in computing systems are well known in the prior art. They are usually operated by electrical signals originating from a computer or peripheral device to energize actuators which cause print hammers to strike a moving record medium. One class of high-speed impact printers are of the back-printing type wherein type characters are provided on a drum, disk or belt which is moved in front of the record medium on which printing is affected by striking from the back. The record medium is itself being continuously fed forward as each line is printed.

Since individual line printers consist of over 100 printing positions and sometimes as many actuators and hammer devices, cost-savings in any aspect of an individual actuator and/or hammer device rapidly multiply into a much larger, cost-saving per printing unit. Furthermore, to reduce costs, most line printers employ a shifting hammer bank so that any given hammer-actuator combination can print in several adjacent columns, thereby reducing the number of hammer-actuators needed. Thus, a heavy, cumbersome hammer-actuator made mostly of machined metal requires expensive, malfunction-prone linkage and typically a DC servo motor to perform the shifting.

Impact printers employing moving type require that the print hammer strike the moving record medium normally and retract immediately to avoid smears caused by the movement of the type and the record medium. Furthermore, high impact momentum is desired so as to produce clear multiple-copies.

The prior art has employed hammers which are theoretically cheaper and simpler to implement than slidable linear hammers. Their inability to provide normalcy and high impact momentum caused poor character coverage due to variations in forms thickness and/or use of multiple-copy forms. This produced, for example, bottom-heavy coverage for single part (or thin) forms and top-heavy coverage for six-part (or thick) forms. Furthermore, shifting of the hammer pivot by as much as 0.005 inch around its nominal centerline as a result of motion along the direction of movement of the type belt, once the hammer begins to contact the form, resulted in character coverage variations within a line of print. Finally, the tight tolerances required to control the hammer pivot location add extra cost and adjustments. Thus more recent prior art has employed linear motion slidable hammers to overcome these problems.

A typical prior art impact-printing, slidable-hammer, actuator mechanism, such as disclosed in U.S. Pat. No. 3,964,384, uses over 20 components per printing position, many of which are constructed of highly machined steel parts. This mechanism furthermore requires complicated assembly procedures using no fewer than five screws and a variety of pins in the fabrication of the actuator and hammer components. A second example is also entirely made out of metal parts which are subject to extensive machining. As disclosed in U.S. Pat. No. 3,726,213 it comprises some 30 separate pieces entailing considerable assembly cost per printing position. Even individual hammer assemblies known in the prior art such as that disclosed in U.S. Pat. No. 3,745,917 utilize over twelve machined pieces, including six fasteners per hammer. Each of the above two hammer, actuator mechanisms provide for extensive adjustment means thereby requiring continuous monitoring and maintenance throughout their useful lives. As a typical hammer bank must undergo 150 million cycles before refurbishing, such considerations are important.

The prior art recognized the fact that in a line printer employing a multitude of hammers, the repetition rate of a given printing position is determined by the cycle time of the actuator moving the hammer position and that a minimum time must elapse between the printing of two successive characters by a given actuator. Therefore the prior art typically has employed means to provide a given hammer with a set of multiple actuators and/or shifting means so that a given hammer and actuator can print in multiple columns. The former method, for example, used pivoted push rods; say where one hammer can be struck by three actuators. Since such a method requires the alignment of three assemblies, it results in costly structures and set-ups and entails many adjustments that periodically need re-setting.

When moving type is mounted directly on a high-mass carrier such as a print drum or a print disk, a high-mass hammer may be employed without causing vibrations of the type carrier and it is possible to effect relatively long contact times. When a low mass, flexible band or belt is employed as the type carrier, the band moves on an air film which requires the print hammer to force the type carrier through the air film before sufficient pressure is applied to the type to cause printing on a multiple copy record medium. An additional factor is that an increase in contact time increases the tendency to smear, which is normally compensated for by low band speeds.

Thus a compromise must be reached between the use of low-mass hammers thereby not perturbing the moving type and the use of high-mass hammers providing the desired impact momentum to produce clean multiple copies and good character coverage. Typically, low-mass high impact-speed hammers are chosen as providing the best performance especially if the hammers have a free-flight component to their travel.

The quality of impact printing suffers from the fact that different characters present different surface areas to be printed resulting in non-uniformity of darkness. The prior art has dealt with this problem, for example, by utilizing complex controls on the actuator-driven solenoid to deliver different impact energies for different characters.

On a related matter, businesses make use of multiple-copy forms which also present different print-energy requirements. When producing multiple-copy forms, prior art printers used forms compressors to eliminate the so-called "first character up" problems wherein the first few characters to be printed on a line are the lightest character on the line since they have to do the most work in compressing the forms. In other printers, hammer mass and/or velocity was increased to overcome this forms resistance. However such practice led to excessive embossing or cutting on single part forms.

Orginially line printers were designed to have one print hammer and one electronic driver for each printed column (generally spaced at ten columns per inch). Within the last decade, many printers have been built in which all or part of each actuator-driver is made to print in more than one column, as mentioned above, resulting in lower cost and lower output speed. Some of the techniques used are:

a. sharing each electronic actuator-device with two or more print hammers;

b. placing the print hammers at every other, or every third, etc. column and horizontally incrementing the record medium being printed on until all the columns are printed;

c. allowing each hammer face to span two or more columns (this technique requires the character font spacing to be equal to or greater than the hammer face width);

d. similar to technique "b", but incrementing the hammer bank instead of the medium.

The present invention relates to technique "d". In the prior art, various techniques are used to implement the scheme, such as incorporating a pushrod into the actuator assembly and allowing the pushrod to pivot. Such techniques generally employ complex mechanical devices involving substantial cost in both their materials and assembly. Furthermore these devices are prone to malfunction and generally require periodic monitoring and maintenance.

Another prior art technique was to utilize a relatively small number of print hammer actuators because of their cost, size and weight and through the use of expensive, complicated, fast-acting d.c. servo motors together with mechanical linkage perform a number of shifting increments within each printed line. The prior art put the designer to a clear tradeoff between complexity and cost, and speed.

A current limiting resistor in series with the solenoid in the actuator was commonly employed in the prior art; it allowed a higher voltage to be used to improve the drive circuit response. A significant amount of energy is dissipated in this resistor making the printer much less energy-efficient than it could otherwise be.

SUMMARY OF THE INVENTION

Thus there is a continuing need to provide lightweight, low-mass, high-impact speed, free-flight, slidable-hammer, impact-printing mechanisms for line printers which can operate at high speeds over long periods of time, that provide excellent print quality for both single- and multiple-forms, that consist of inexpensive, readily-assemblable modular components that are not complex in design or in set up and are easy to maintain and repair and/or replace.

Accordingly, it is a primary objective of the present invention to provide a reliable high-speed impact printing mechanism that provides high print quality on either single or multiple copies consisting of low-cost modular components, which can print 50 million lines before refurbishing, that requires no preventative maintenance, and is easy to service with no special tools. It is another object of the present invention to provide good character coverage using linear hammers without the need for complicated drive current-limiting or character recognition features.

Another object of the present invention is to provide smear-free multiple copies by decreasing the time of contact between the moving type and moving record medium by employing low-mass print hammers moved at very high free-flight speeds.

It is another object of the invention to provide high linear momentum printers capable of creating high impulse forces, eliminating the need for forms compressors.

It is yet another object of the present invention to provide a novel means of piggy-backing several actuator mechanisms so as to allow them to time-share on different print columns. It is another object of the present invention to employ interchangeable actuator and hammer assemblies within a given actuator module or hammer module respectively, to provide for easy servicing and low design cost.

It is another object of the present invention to provide a novel means of construction utilizing interfitting components so as to permit inexpensive assembly utilizing few, if any, tools.

It is another object of the present invention to employ hammer and actuator modules utilizing a minimum number of components, each component performing a variety of tasks, so as to further minimize the cost of assembly and the service costs and increase the reliability of the mechanism.

Another object of the invention is to make maximum use of inexpensive, easily moldable, plastics so as to minimize fabrication costs and reduce the weight and complexity of the printing mechanism.

It is another object of the present invention to require only a single manufacturing adjustment of the moveable parts and to require no preventative maintenance for at least 150 million print cycles.

It is another object of the present invention to provide a lightweight hammer bank capable of being readily shifted by a low-cost, low-maintenance mechanism without sacrificing line-printing speed for printing in selected columns.

It is yet another object of the present invention to eliminate the energy lost by the presence of a current-limiting resistor in the actuator drive circuit.

It is yet another object of the present invention to utilize lower drive currents, thereby reducing the operating costs of the hammer bank.

It is another object of the present invention to require minimum field adjustments.

It is another object of the present invention to permit individual modular components to be replaced without requiring removal of the hammer bank assembly.

In accordance with these and other objects of the present invention, there is provided lightweight hammer modules consisting of individual low-mass hammers and related components and lightweight actuator modules consisting of individual actuators and related components, each composed of interfitting components so that each module is inexpensively assemblable without tools and is held together, in the case of the hammer module, solely by the interfitting of its components and, in the case of the actuator module, by the interfitting of its components and the use of three fasteners. To reduce fabrication costs, components are constructed of lightweight, inexpensive, commonly-available materials wherever possible.

In operation, a bank of interchangeable hammer modules, each individually movable by a group of actuator modules consisting of a group of actuators when a desired character on a flexible band-type carrier is opposite each of the print hammer positions. Each low-mass print hammer is driven by an associated module of high speed actuators to create high linear momentum at the time of impact with the type carrier. Low-mass springs are provided to rapidly return the low-mass print hammers to their normal ready position.

Each actuator within a given actuator module and each hammer within a hammer module are interchangeable so as to further limit the design, fabrication, and repair costs. A further factor in reducing the cost of the present hammer bank, is the use of a single adjustment which should last for the entire life of 150 million cycles referred to above. Furthermore, no expensive set up procedures are required. Increased hammer momentum is used to eliminate the need for forms compressors.

The extensive use of moldable composites reduces individual parts costs, and the maximum use of integrated subassemblies such as a flexure-pivot armature assembly makes the subassemblies readily amenable to a fully automated assembly line. A typical actuator-hammer assembly is projected to cost about one-third the cost of the present actuator-hammer assemblies. Further advantages of the present invention are a reduction of the drive current required to about half that of the prior art and that the light-weight construction of the hammer modules comprising the hammer bank permits the use of a simple, low-cost shifting mechanism allowing a hammer to print in adjacent columns. This result follows from the fact that more hammers may be economically employed within the hammer bank without extracting an economic or weight penalty because of the hammer module's inexpensive, lightweight design. Furthermore, since the actuator modules are separate from the hammer modules on which they act, only the hammer modules need be shifted. Thus a slower shifting cycle can be tolerated for the same line-printing speed of a bank employing fewer hammers and a simpler mechanism will suffice to perform the shifting because of the resulting low weight which needs to be shifted. A simple open-loop incremental stepping motor coupled to the hammer bank by a flexible polyester elastomer strip provides the necessary precision force needed.

DETAILED DESCRIPTION OF THE PREFERRED EMBODIMENT

Figure 1:
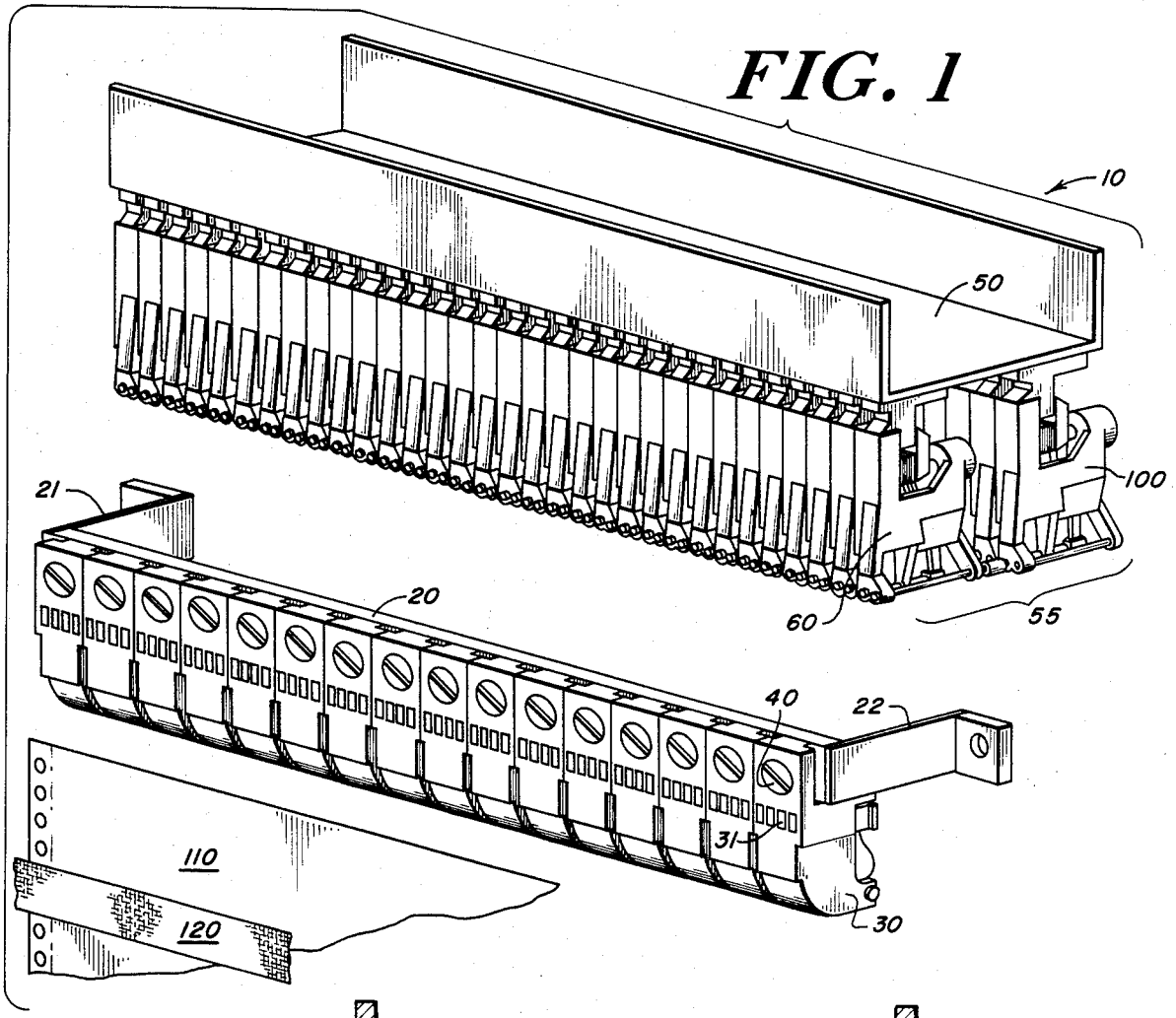
FIG. 1 is a perspective view of the printing-head assembly employing hammer modules and actuators modules.

Referring now to FIG. 1, a printing-head assembly 10 is adapted to be mounted on the frame of a line printer (not shown). Hammer-module frame 20 and actuator module frame 50 comprise the main sub assemblies of the printing-head 10. Individual hammer module 30 are attached to frame 20 by screws 40. Similarly, actuator modules 55, shown in FIG. 1 as groups of two actuators, 60 and 100, are mounted on frame 50. Recording medium 110 and moving type band 120 are shown in outline form.

Figure 2:
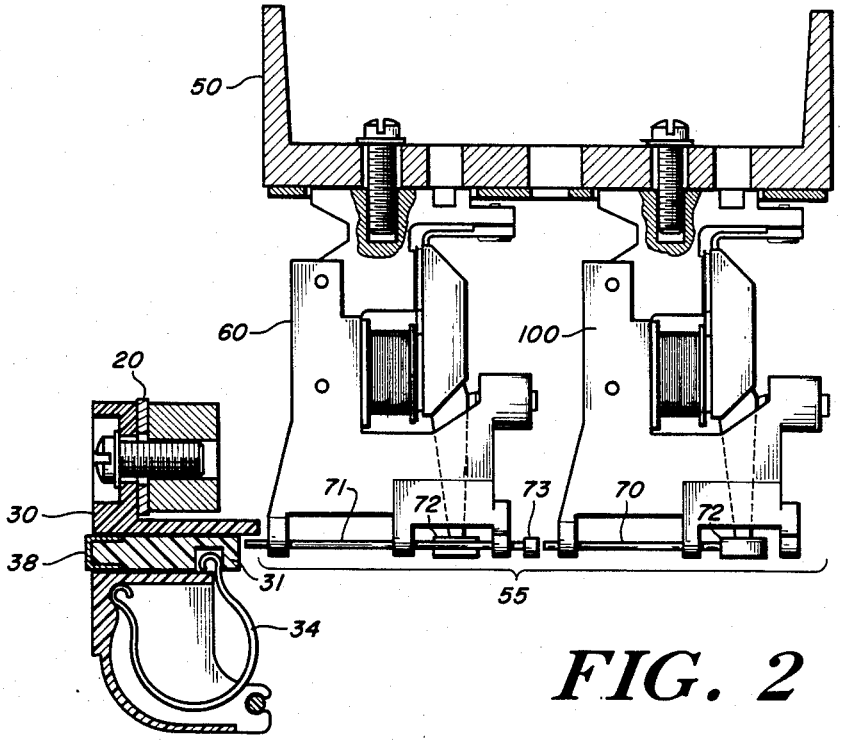
FIG. 2 is a cross-section of the preferred embodiment of a hammer-module, actuator-module combination.

In the preferred embodiment, a print hammer 31 is provided at every other columnar position. The print hammers are spaced on 0.20 inch centers so that a hammer is aligned with every other column. An actuator module 55 consists of two actuator assemblies 60 and 100 located on 0.40 inch centers and arranged in two rows with front row actuator 60 laterally offset from back row actuator 100. As shown in FIG. 2, for a given print-hammer location, a front row actuator 60 supports extension pushrod 71 transmitting the force developed in pushrod 70 associated with second row actuator 100. On this manner, actuator module 55 employs pushrod 70 associated with actuator 60 and pushrod 70 and extension pushrod 71 associated with actuator 100 to propel hammer 31 within hammer module 30. The extension pushrod is allowed to travel with the hammer during the printing cycle with no measurable effect on character print quality.

Figure 3A:
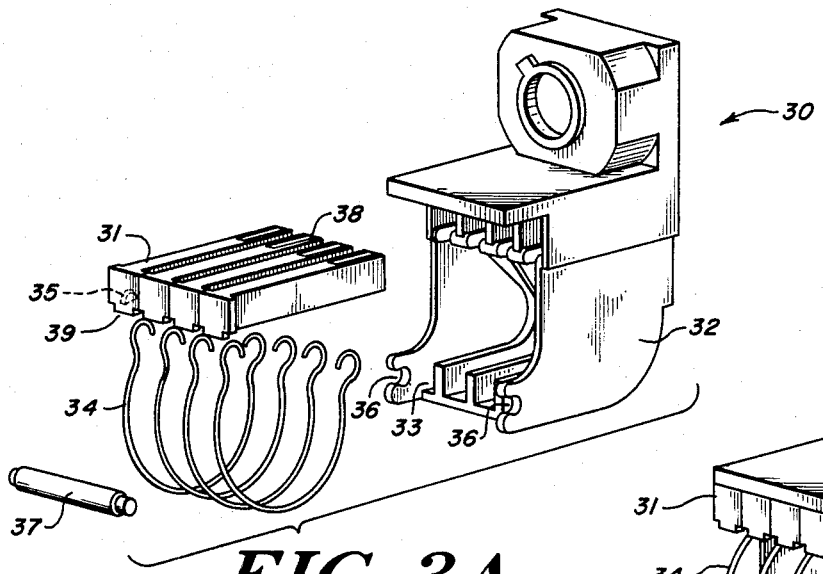
FIG. 3A is an exploded view of the hammer module.
Figure 3B:
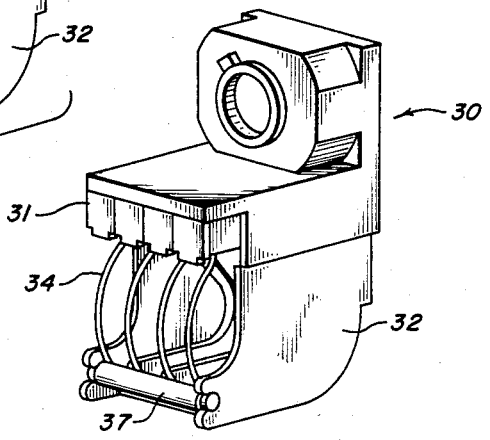
FIG. 3B is a perspective view of the assembled hammer module.

FIG. 3A is an exploded view of hammer module assembly 30. In the illustrated hammer module, four identical print hammers 31 are slidably housed in integral hammer-housing and hammer return-spring housing 32 which is provided with slots 33 to receive one end of hammer return springs 34. Print hammer 31 has detente 35 which is to slidably receive the other end of return-spring 34. Dove-tailed grooves 36 in hammer housing 32 receives and retains round hammer return spring keeper 37. All of the components comprising hammer module 30 slidably fit together without the use of tools or fasteners of any sort. The unit is held together in an operative assembly in a ready position upon the insertion of keeper 37. FIG. 3B shows an assembled hammer module.

The preferred embodiment makes maximum use of multiple-use components, constructed of light-weight, easily-formed, injection-molded composites which reduces the module's cost and weight as well as its fabrication cost. Coupled with the above-mentioned slidable assembly, purposely designed for automated assembly, the resulting cost per hammer module is kept to a minimum. Further cost reduction is implicit in the interchangeability of each hammer module thereby effecting a savings because of the higher volume produced.

In an experimental embodiment designed to test the upper limits of the present invention, the type font was moved horizontally 144 inches per second, producing printing speeds of 2400 print cycles per minute without producing character smear. This result is in part due to the use of free-flight hammers with high impact momentum, and in part, to a design permitting both the hammer housing 32 and the hammer 31 itself to move slightly in a horizontal direction to follow the type font throughout most of the impression time.

The print hammers in the preferred embodiment are injection-moldable composites containing carbon fibers because of its high modulus of elasticity and low density. They are faced on their print side with metallic implant 38 of hardened steel. Print hammer 31 is provided with an enlarged head 39 opposite the print end of the hammer to provide for contact with pushrods and extension pushrods of the actuator assembly. Spring 34 is designed to be strong enough to return print hammer 31 to its normal ready position.

Using a print hammer made of carbon fortified nylon 6/6 with teflon fiber as a lubricant, allowing for a fast mechanical response with lower impact forces, thereby permitting print hammer energy to be increased without exceeding critical force levels which would produce excessive embossing or cutting on single-part forms. The effective mass of the print hammer-spring combination is of the order of 0.82 grams, the impact velocity is 178 inches per second with a print energy of 83,700 ergs and a momentum of $8.32\times10^{-4}$ pound-seconds. These figures have eliminated the need for complex hammer printing-energy variations due to character surface area differences and the so-called "first character up" problem so with the present invention form compressors are not required. This results in uniform printing darkness within a line regardless of the characters printed and darker six-part printing without excessive embossing or cutting on single-part forms.

Figure 4A:
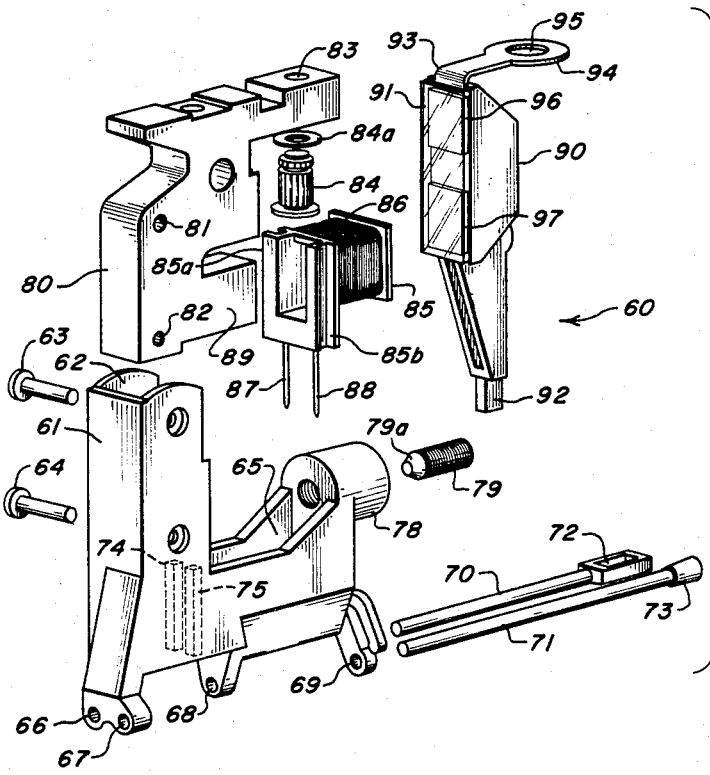
FIG. 4A is an exploded view of an actuator assembly.

FIG. 4A is an exploded view of actuator 60, identical in all respects with actuator 100, which together with actuator 100 forms actuator module 55. With reference to FIG. 4A, integral armature- and pushrod-guide and stator housing 61, formed out of the above-mentioned injection-molded composite contains groove 62 into which stator 80 insertably slides. Stator 80 is held in place by rivets 63 and 64 passing through holes 81 and 82 in stator 80. Housing 61 further contains groove 65 to slidably accept integral armature and return flexure 90. Integral with housing 61 are pushrod guides 66 and 68 and extension pushrod guides 67 and 69 into which pushrod 70, and extension pushrod 71, respectively, slidably insert. Pushrod 70 contains an enlarged end with slot 72 to slidably receive armature tip 92. Extension pushrod 71 contains head 73 which acts as a stop as well as a surface against which the pushrod from adjoining actuator 100 can act.

Housing 61 is further outfitted with holes 74 and 75 designed to receive solenoid terminals 87 and 88 and to act as conduits for electronic signal wires 76 and 77. Housing 61 receives backstop screw 79 at appendage 78. Backstop screw 79 contains a resilient insert **79*a* and is used to set the limits of the power stroke of the armature 90. This is a manufacturing assembly set up and is not intended as a field adjustment. Insert 79*a*** is a resilient material to reduce the return impact force, and to eliminate mechanical cross-talk.

Stator 80 is of width designed to snuggly fit within groove 62 of housing 61, and is to be held in place by rivets 63 and 64 passing through holes 81 and 82 of stator 80. Stator 80 is constructed from ferromagnetic material and is designed to provide a magnetic path for the magnetic field induced by solenoid 86; said magnetic path is closed by the ferro-magnetic material 91 contained in armature 90. Stator 80 is provided with hole 83 to receive offset ribbed drive stud 84 which in combination with disc spring washer nut firmly clamps armature 90 in place. This combination maintains the clamping force despite slight dimensional changes due to thermal and humidity variation.

Integral armature and return-flexure 90 is made of injection-moldable polymer material and is provided with ferromagnetic insert 91. As armature 90 is received into groove 65 in housing 61, it slidably engages pushrod 70 at slot 72 as armature tip 92 extends below the bottom of housing 61. Armature 90 is provided with an integral flexure at point 93 serving as a pivotal link between the body of armature 90 and foot 94. Foot 94 is anchored to stator 80 by drive stud and disc spring washer combination 84 and **84*a* passing through hole 83 in stator 80 and hole 95 in foot 94. Thin plastic film 96 and 97 is permanently attached to the armature pole faces to reduce the residual magnetism in the magnetic circuit after armature insert 91 closes against stator 80**.

In the preferred embodiment, the armature insert 91 and the stator 80 are sintered powdered iron containing 3% silicone iron pressed to a nominal density of 7.2 grams per cc.

Figure 4B:
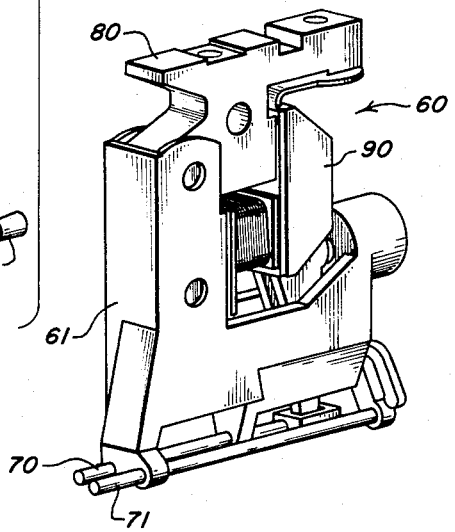
FIG. 4B is a perspective view of the assembled actuator.

Bobbin 85 containing armature coil 86 is outfitted with terminals 87 and 88 which slidably engage holes 74 and 75 of the armature guide 61. As solenoid bobbin 85 is designed to snuggly fit over arbor 89 of stator 80, dovetails **85*a* and 85*b* on bobbin 85 slidably engage mating dovetail on housing 61 to retain solenoid assembly 85 and 86 in place once stator 80 is inserted in housing 61. Due to the slidably interlocking fit of all the components of actuator mechanism 60, the entire actuator assembly can be configured with the single stud/-washer combination 84 and 84*a*. FIG. 4B** shows an assembled actuator.

Figure 5:
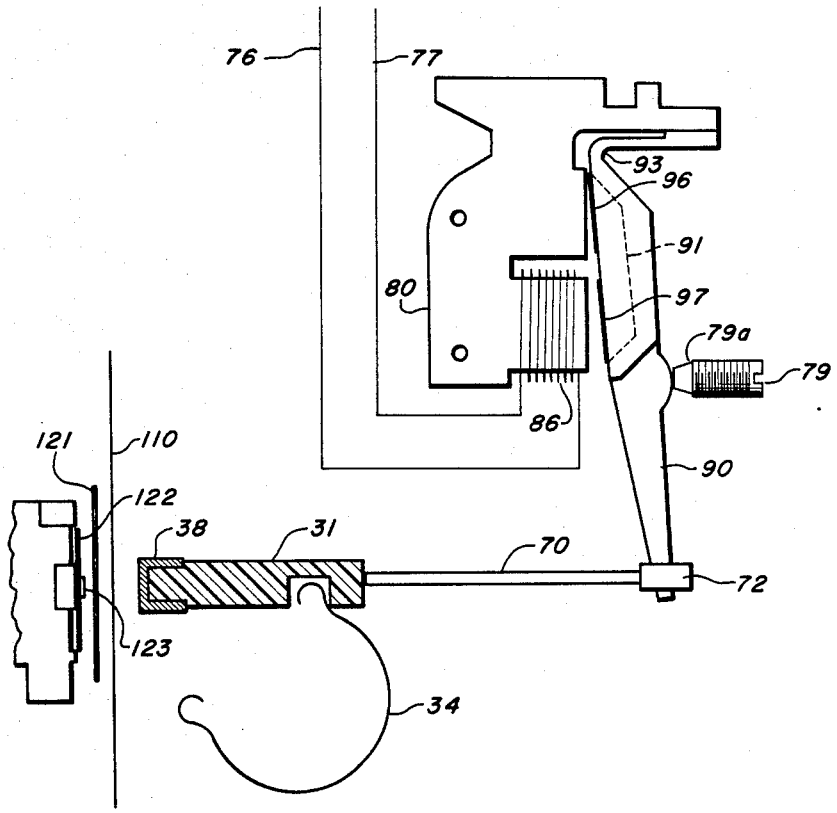
FIG. 5 is a schematic cross-section of a hammer-actuator combination.
Figure 6A:
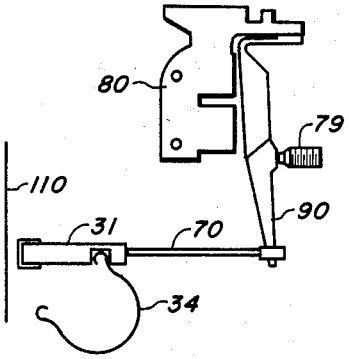
FIGS. 6A, 6B, 6C, 6D and 6E show various points in a print cycle.
Figure 6B:
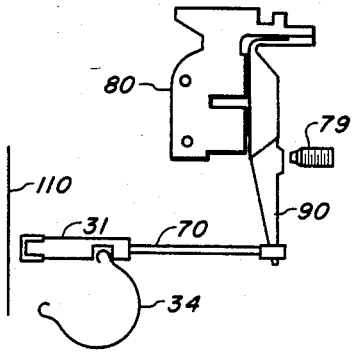
Figure 6C:
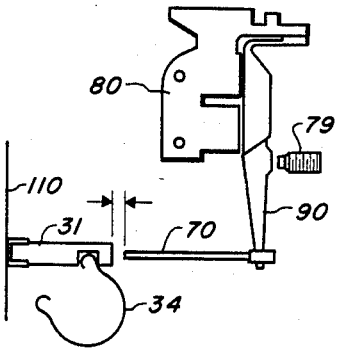
Figure 6D:
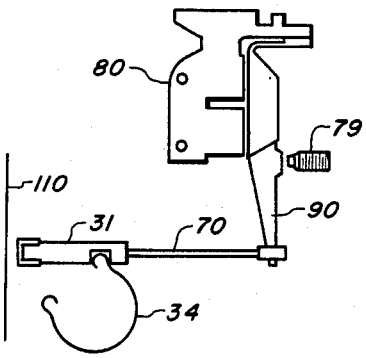
Figure 6E:
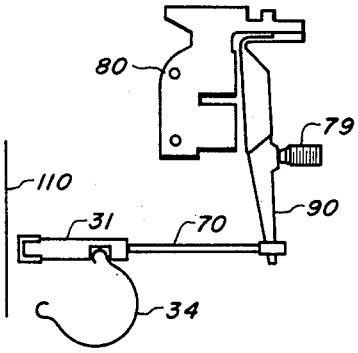
Figure 7:
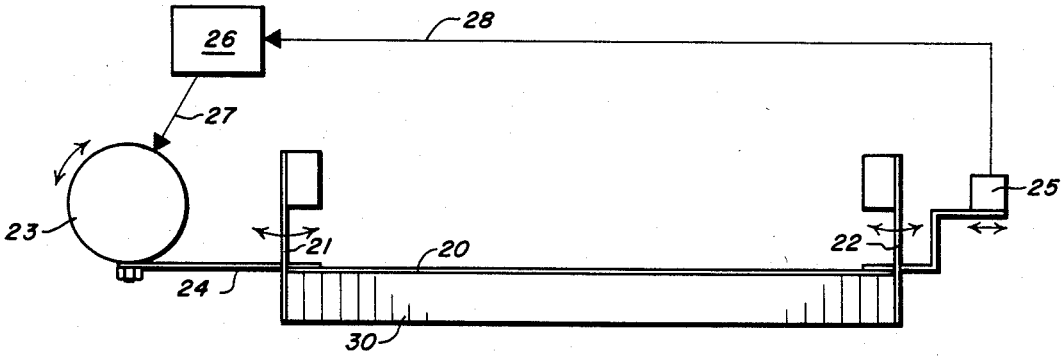
FIG. 7 is a plan view of the preferred embodiment of a hammer bank shifting mechanism.

The operation of the printing-head assembly is best understood with reference to FIGS. 5 and 6; showing cross-sectional views of the moveable elements of an actuator-hammer combination and FIG. 7, a plan view of the hammer bank shifting mechanism. Initally, in the ready position, FIG. 5 and FIG. 6A, armature 90 rests against backstop screw 79 under the tension provided by flexure 93 and return spring 34. Print energy is obtained by electrically exciting solenoid coil 86 resulting in magnetic forces of attraction between stator 80 and armature ferromagnetic insert 91. The lever section of armature 90 reacts against pushrod 70 which accelerates print hammer 31 during the power stroke FIG. 6B. When the plastic film pieces 96 and 97 attached to armature 90 reach stator 80 at the end of the power stroke (closure), print hammer 31 continues on as a projectile in free-flight reacting only to forces of windage, friction and a return spring 34. At the end of free-flight, FIG. 6C, print hammer metallic insert 38 strikes the backs of the forms 110 being printed on, resulting in a normal reaction transmitted through the forms, an inked ribbon 121, a continuously moving type belt 122 and into the platen 123. The reaction conforms to the embossed shape of the type and transfers the image of the type onto paper forms 110.

This reaction force is reflected by the platen 123 back into the sandwiched font 122, ribbon 121, paper 110, and print hammer insert 38, forcing print hammer 31 away from the paper towards the still-closed armature lever 90 FIG. 6D. Much of the kinetic energy still in the hammer is dissipated when the returning hammer strikes the armature lever moving away from stator 80. Most of the energy is dissipated as induced currents in the coil 86 and eddy currents in the magnetic circuit. Hammer 31, pushrod 70 and armature lever 90 continue back, controlled by the hammer return-spring 34, until striking the backstop screw insert **79*a***, thereby settling in a ready position FIG. 6E awaiting the next print cycle.

Referring now to FIG. 7, a plan view of the preferred embodiment of the hammer bank frame shifting mechanism, an aluminum bar 20 carries seventeen hammer modules 30. Hammer module frame 20 is held in place by leafsprings 21 and 22 in a way which allows it to move laterally back and forth. Incremental open-loop stepping motor 23 is coupled to bar 20 by flexible polyester elastomer band 24. Stepping motor 23 is capable of moving in increments of 0.02 inch per step by signals presented on line 27 by controller 26. Controller 26 receives electronic position sensing signals from stator 25 along electric path 28. Sensor 25 is coupled to frame 20. To print a line of standard pitch, ten characters per inch, hammer module frame 20 is initially in the leftmost position so each hammer is aligned with an odd column (1, 3, 5, 7, etc.); one character font is scanned and the appropriate characters printed.

In response to an electronic signal from controller 26, step motor 23 advances five incremental steps, causing hammer module frame 20 to be shifted 0.10 inches to the right aligning the hammers with the even columns and the print cycle is repeated. Sensor 25 detects that bar 20 is at the beginning of its travel and signals controller 26 that step motor 23 is maintaining synchronization of the hammers with the print columns.

Compressed pitch at approximately fifteen characters per inch is accomplished by using a print band with smaller characters, and hammer module frame 20 is shifted twice per printed line in increments of three steps of motor 23, producing three character font scans or print cycles per line.

Figure 8:
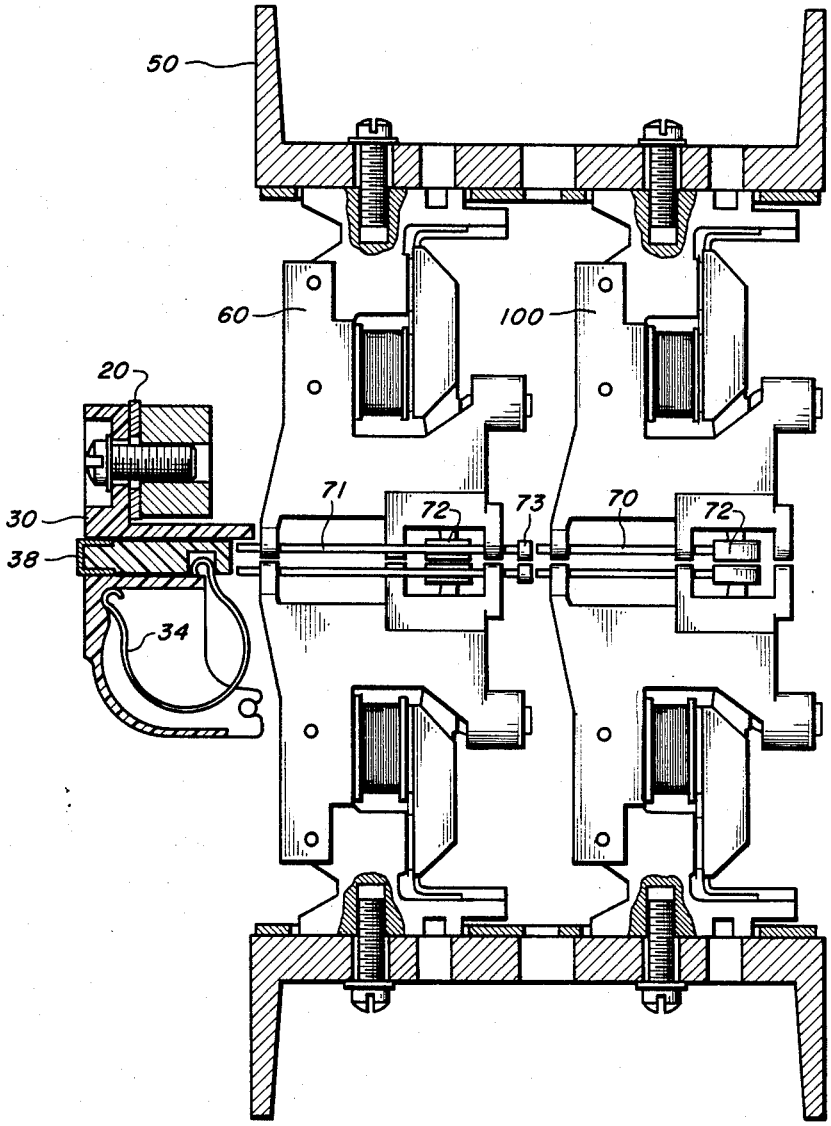
FIG. 8 is a cross-section of an alternate embodiment of a hammer-module, actuator-module combination.

Recalling that the cycle time of actuators determines the minimum time which must be allowed between their printing of two successive characters, additional actuators per column increase the maximun possible printing rate. Thus in an alternative embodiment shown in FIG. 8, an actuator module comprises four actuators per print position. The hammers are provided on 0.10 inch centers, or one per column, thereby doubling the maximum possible printing rate of lines per minute over that provided when module consists of only two actuators and the hammers are mounted on 0.20 inch centers and must be actuated twice per line.

What is claimed is:

1. A free-flight hammer, impact-printing apparatus utilizing a shifting hammer bank, the hammers of which strike a moving record medium normally relative to the medium surface, the apparatus comprising:

a plurality of interchangeable actuator modules responsive to electric signals, each of said actuator modules including at least one actuator assembly which includes a means for housing a stator, a solenoid assembly and an armature, said stator being locked in said stator housing, said solenoid assembly being mounted between said stator and said armature, said armature being attached to said stator and including flexure means which allows said armature to move relative to said stator, said stator housing further including a guide means for pushrods, one of said pushrods being a capturing pushrod which includes means for capturing a portion of said armature to allow said armature to contol the movement of said capturing pushrod;

a plurality of interchangeable hammer modules including a plurality of individual linear motion, slidable hammers, said individual hammers being slidably mounted in a side by said relationship in a hammer housing which includes means for capturing a hammer return spring for each hammer mounted in said hammer housing, one end of each of said springs being attached to a corresponding hammer, said hammers and springs being held in said hammer housing by a securing means positioned against said springs;

means for mounting said actuator modules relative to said hammer modules so that said pushrods cause the firing of individual hammers of said hammer modules.

2. Apparatus according to claim 1 wherein said armature is attached to said stator by means of a single fastener, said single fastener comprising:

a headed stud containing a first set of ribs disposed longitudinally along a first portion of the shank of said stud and a second set of ribs disposed longitudinally along a second portion of said shank, said second set of ribs offset from said first set of ribs by one-half pitch, and a flexible washer having a surface normally flex-loaded concave and adapted to receive the shank of said stud;

wherein said stator is adapted to receive and retain by interference fit said offset ribbed shank; and wherein a foot end of said armature is apertured to receive said offset ribbed shank;

whereby said headed stud and flexible washer cooperate to anchor said foot end to said stator when said offset ribbed shank is driven into and retained by said interference fit, thereby flex-loading said washer and preventing relative motion of said foot and said stator.

3. Apparatus according to claim 1 wherein actuator assemblies of each actuator module are positioned in operative relation to adjacent actuator assemblies.

4. Apparatus according to claim 3 wherein said pushrods are slidably mounted on and supported by said stator housing, said pushrods being adapted to engage and respond to pushrods associated with other actuator assemblies within said actuator module.

* * * * *